US007682470B2

(12) United States Patent
Bettles et al.

(10) Patent No.: US 7,682,470 B2
(45) Date of Patent: Mar. 23, 2010

(54) MAGNESIUM ALLOY

(75) Inventors: Colleen Joyce Bettles, Victoria (AU); Mark Antony Gibson, Victoria (AU)

(73) Assignee: Cast Centre Pty Ltd (AU)

( * ) Notice: Subject to any disclaimer, the term of this patent is extended or adjusted under 35 U.S.C. 154(b) by 0 days.

(21) Appl. No.: 11/910,339

(22) PCT Filed: Apr. 4, 2006

(86) PCT No.: PCT/AU2006/000447

§ 371 (c)(1),
(2), (4) Date: Nov. 26, 2007

(87) PCT Pub. No.: WO2006/105594

PCT Pub. Date: Oct. 12, 2006

(65) Prior Publication Data

US 2009/0136380 A1 May 28, 2009

(30) Foreign Application Priority Data

Apr. 4, 2005 (AU) ..... 2005901623

(51) Int. Cl.
*C22D 23/06* (2006.01)

(52) U.S. Cl. ..... 148/420; 420/405; 420/406; 420/408; 420/409

(58) Field of Classification Search ..... 148/420; 420/405, 406, 408, 409
See application file for complete search history.

(56) References Cited

U.S. PATENT DOCUMENTS 6,193,817 B1 * 2/2001 King et al. ..... 148/420

FOREIGN PATENT DOCUMENTS

| | | | |
|---|---|---|---|
| EP | 499321 A1 | | 8/1992 |
| GB | 1067915 | * | 5/1967 |
| JP | 2000265228 A1 | | 9/2000 |
| WO | WO 96/24701 A1 | | 8/1996 |
| WO | WO 04/001087 A1 | | 12/2003 |

* cited by examiner

*Primary Examiner*—Sikyin Ip
(74) *Attorney, Agent, or Firm*—Rodman & Rodman

(57) ABSTRACT

A magnesium-based alloy consists of 1.5-4.0% by weight rare earth element(s), 0.3-0.8% by weight zinc, 0.02-0.1% by weight aluminum, and 4-25 ppm beryllium. The alloy optionally contains up to 0.2% by weight zirconium, 0.3% by weight manganese, 0.5% by weight yttrium and 0.1% by weight calcium. The remainder of the alloy is magnesium except for incidental impurities.

9 Claims, 9 Drawing Sheets

Comparison of the creep response at 177°C and 90 MPa for Alloys A, B and C. A curve for Alloy B at 177°C and 100 MPa is also shown. The insert graph shows the initial primary response for Alloy B at the two stress levels.

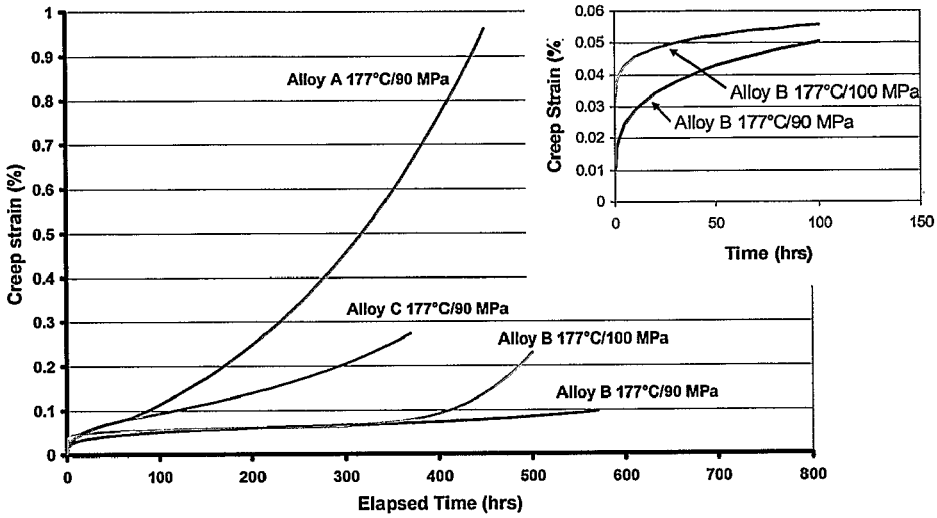
Figure 1 Comparison of the creep response at 177°C and 90 MPa for Alloys A, B and C. A curve for Alloy B at 177°C and 100 MPa is also shown. The insert graph shows the initial primary response for Alloy B at the two stress levels.

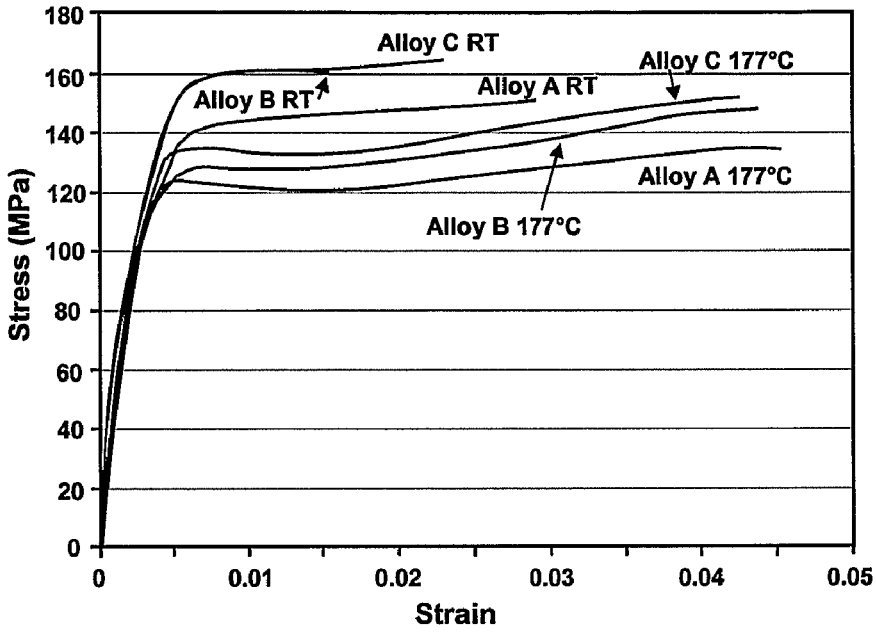
Figure 2 Comparison of the tensile behaviour of Alloys A, b and C at room temperature and 177°C.

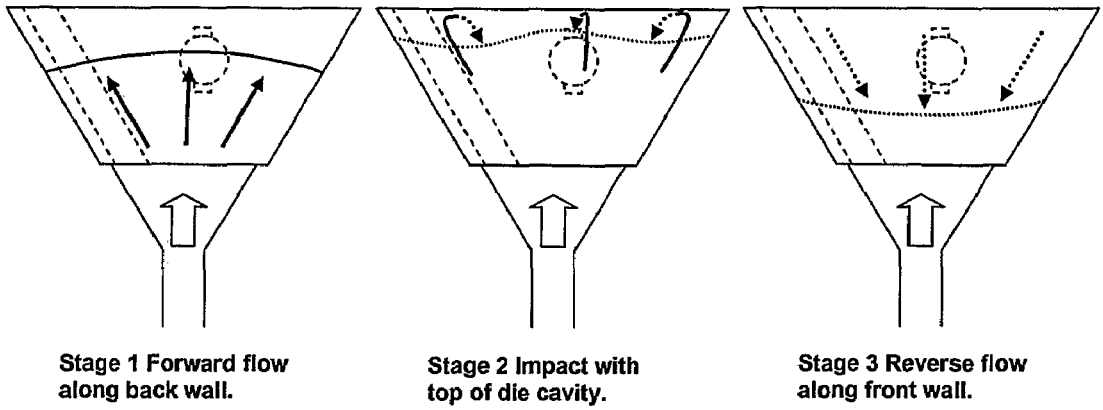
Figure 3 Diagram showing the three stages of flow during filling of the diecastability test die.

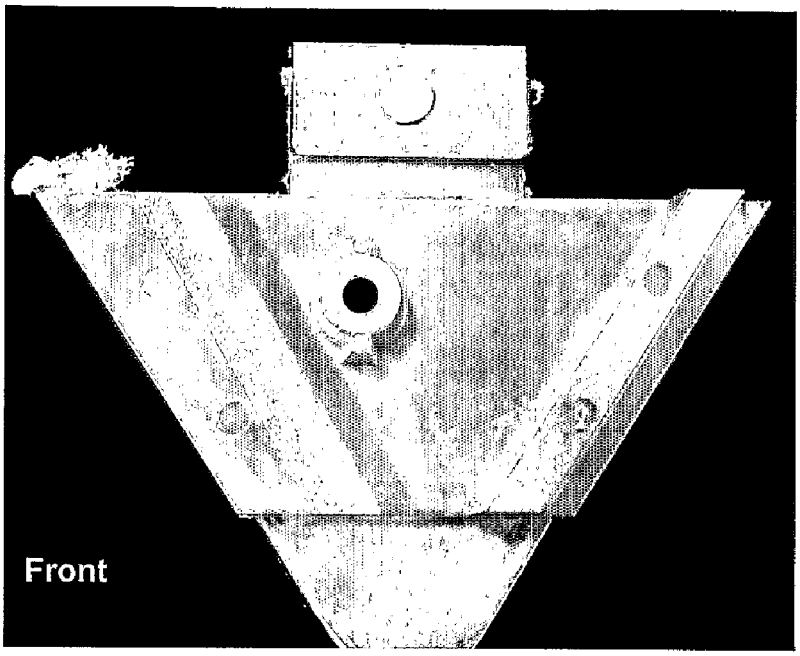
Figure 4 Picture of the top surface of a test piece from the castability die cast from Alloy E.

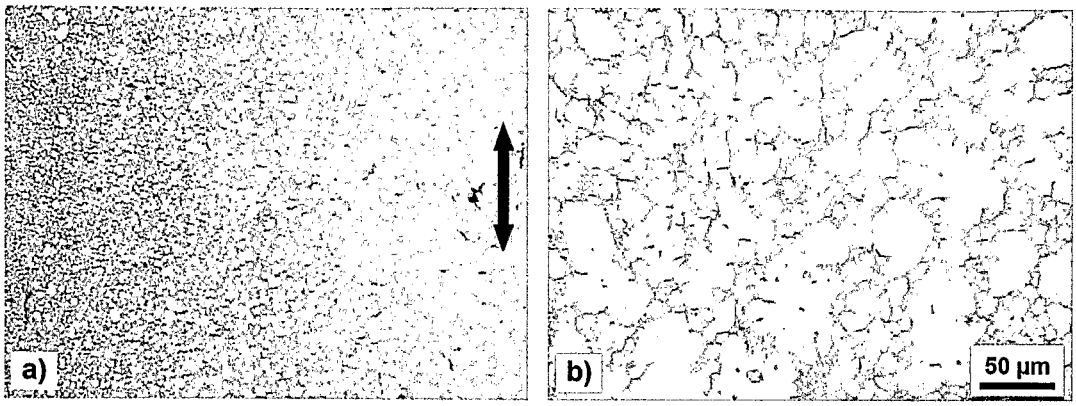

Figure 5 Photomicrographs taken at high magnification of a) the 'skin' region near the surface of the test piece (left-hand side of image is close to the surface) and b) of the 'core' region near the centre of the specimen from the gauge length region of HPDC tensile test piece specimens in the as-cast condition for Alloy G. The double-headed arrow in (a) indicates the long axis of the tensile test piece.

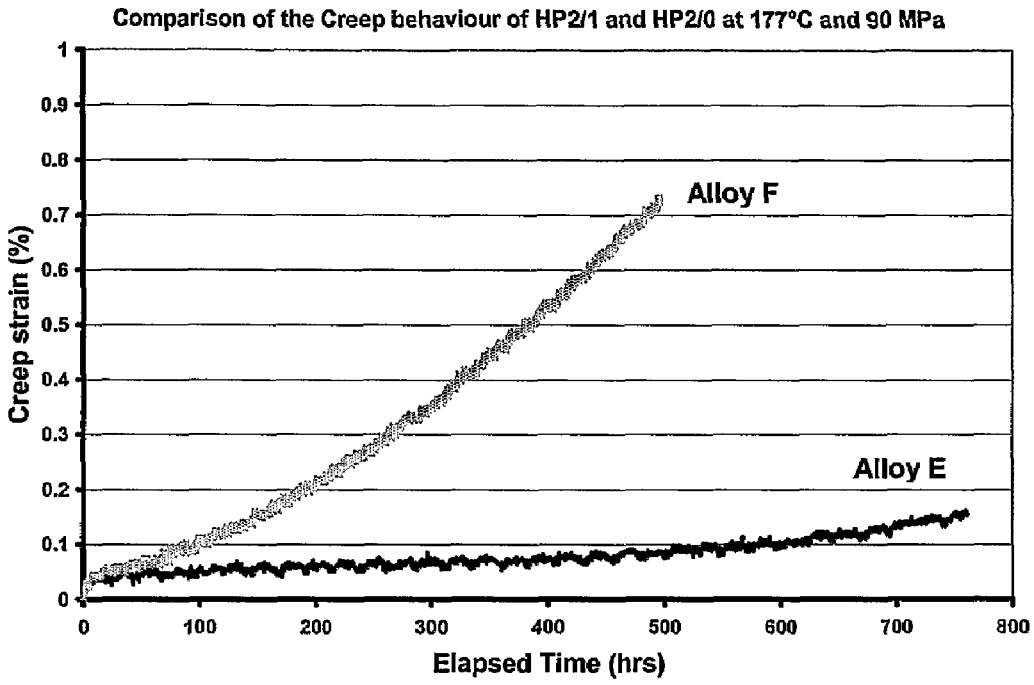
Figure 6 Creep curves at 177°C and 90 MPa comparing the creep behaviour of a composition with less than optimum Al content (Alloy F) with a composition within the optimum Al content composition range (Alloy E).

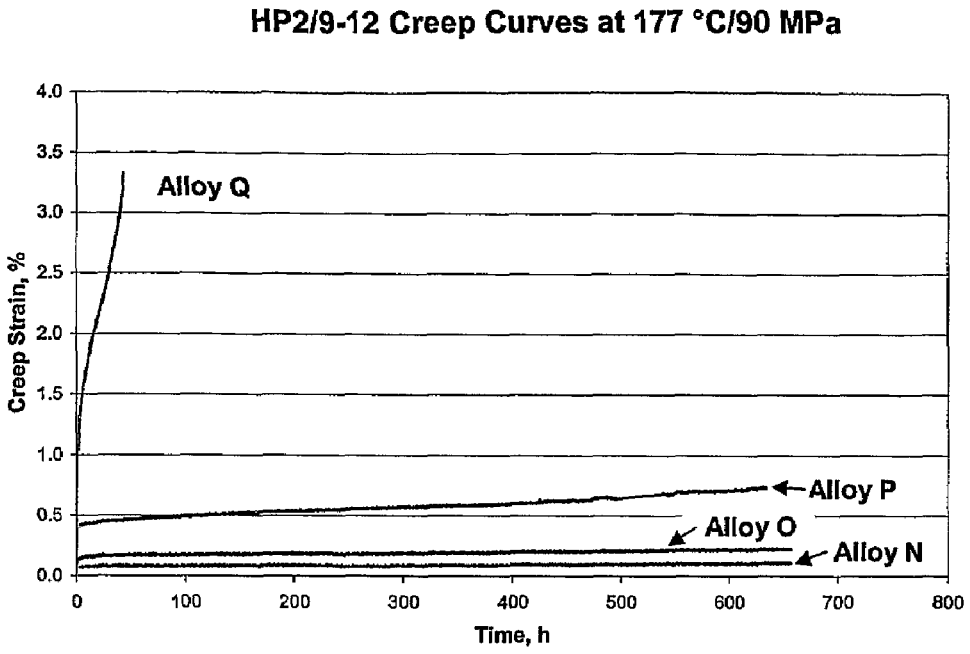
Figure 7 Creep curves at 177°C and 90 MPa showing the influence of increasing Al content (from 0.05 wt.% in Alloy N, to 0.09 wt.% in Alloy O, to 0.12 wt.% in Alloy P, to 0.23 wt.% in Alloy Q) on the creep behaviour.

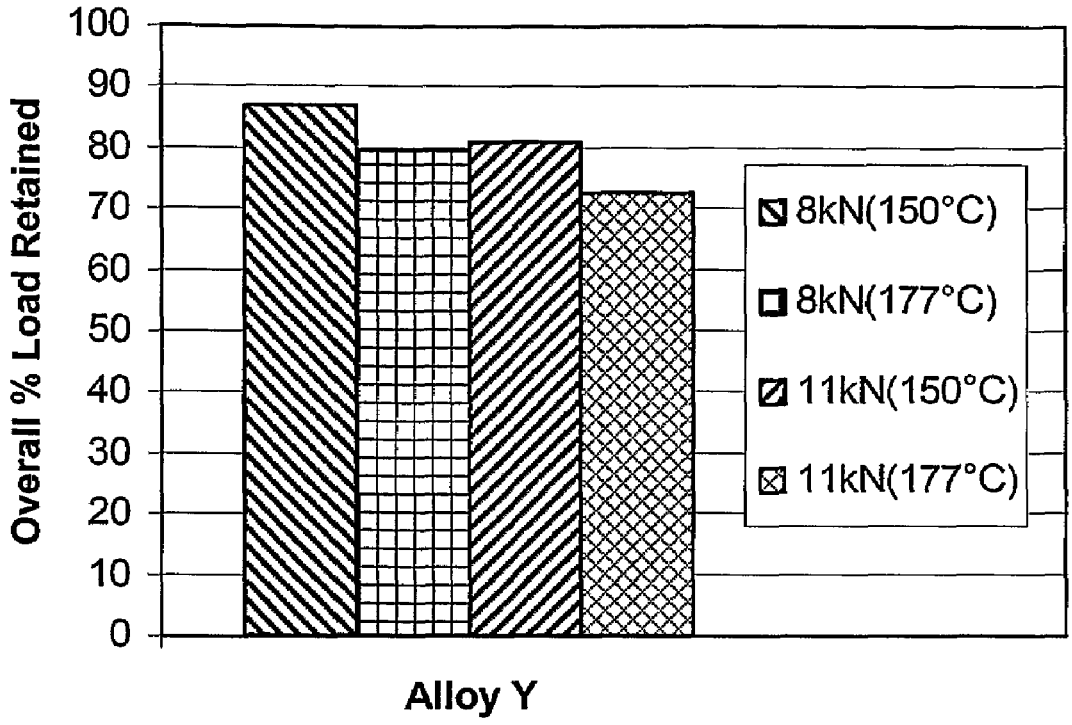
Figure 8: Overall BLR behaviour for Alloy Y.

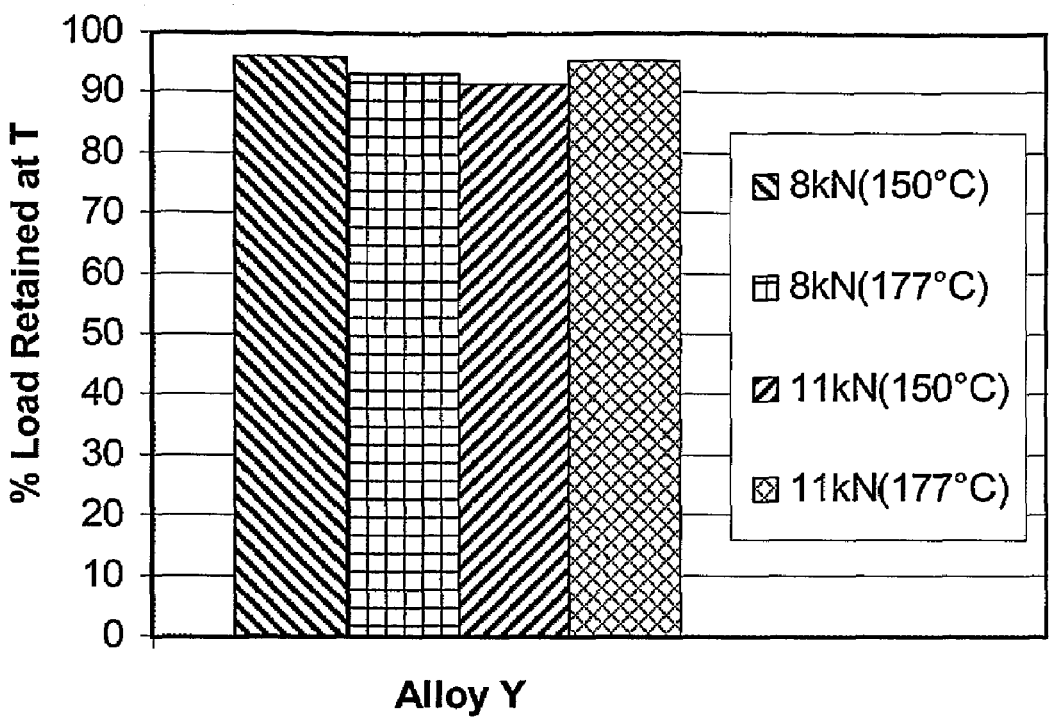
Figure 9: BLR behaviour at temperature for Alloy Y.

MAGNESIUM ALLOY

FIELD OF THE INVENTION

The present invention relates to magnesium alloys and, more particularly, to magnesium alloys which can be cast by high pressure die casting (HPDC).

BACKGROUND TO THE INVENTION

With the increasing need to limit fuel consumption and reduce harmful emissions into the atmosphere, automobile manufacturers are seeking to develop more fuel efficient vehicles. Reducing the overall weight of vehicles is a key to achieving this goal. Major contributors to the weight of any vehicle are the engine and other components of the powertrain. The most significant component of the engine is the cylinder block, which makes up 20-25% of the total engine weight. In the past significant weight savings were made by introducing aluminium alloy cylinder blocks to replace traditional grey iron blocks, and further weight reductions of the order of 40% could be achieved if a magnesium alloy that could withstand the temperatures and stresses generated during engine operation was used. Development of such an alloy, which combines the desired elevated temperature mechanical properties with a cost effective production process, is necessary before viable magnesium engine block manufacturing can be considered.

HPDC is a highly productive process for mass production of light alloy components. While the casting integrity of sand casting and low pressure/gravity permanent mould castings is generally higher than HPDC, HPDC is a less expensive technology for higher volume mass production. HPDC is gaining popularity among automobile manufacturers in North America and is the predominant process used for casting aluminium alloy engine blocks in Europe and Asia. In recent years, the search for an elevated temperature magnesium alloy has focused primarily on the HPDC processing route and several alloys have been developed. HPDC is considered to be a good option for achieving high productivity rates and thus reducing the cost of manufacture.

SUMMARY OF THE INVENTION

In a first aspect the invention provides a magnesium-based alloy consisting of, by weight:

1.5-4.0% rare earth element(s),
0.3-0.8% zinc,
0.02-0.1% aluminium,
4-25 ppm beryllium,
0-0.2% zirconium,
0-0.3% manganese,
0-0.5% yttrium,
0-0.1% calcium, and the remainder being magnesium except for incidental impurities.

Throughout this specification the expression "rare earth" is to be understood to mean any element or combination of elements with atomic numbers 57 to 71, ie. lanthanum (La) to lutetium (Lu).

Preferably, alloys according to the present invention contain at least 95.5% magnesium, more preferably 95.5-97% magnesium, and most preferably about 96.1% magnesium.

The neodymium content is preferably 1.0-2.5% by weight. In one embodiment, the neodymium content is 1.4-2.1% by weight. In another embodiment, the neodymium content is greater than 1.7%, more preferably greater than 1.8%, more preferably 1.8-2.0% and most preferably about 1.9%. In another embodiment, the neodymium content is 1.7-1.9% by weight. The neodymium content may be derived from pure neodymium, neodymium contained within a mixture of rare earths such as a misch metal, or a combination thereof.

Preferably, the content of rare earth(s) other than neodymium is 0.5-1.5%, more preferably 0.8-1.2%, more preferably 0.9-1.2%, such as about 1.1%. Preferably, the rare earth(s) other than neodymium are cerium (Ce), lanthanum (La), or a mixture thereof. Preferably, cerium comprises over half the weight of the rare earth elements other than neodymium, more preferably 60-80%, especially about 70% with lanthanum comprising substantially the balance. The rare earth(s) other than neodymium may be derived from pure rare earths, a mixture of rare earths such as a misch metal or a combination thereof. Preferably, the rare earths other than neodymium are derived from a cerium misch metal containing cerium, lanthanum, optionally neodymium, a modest amount of praseodymium (Pr) and trace amounts of other rare earths.

In a preferred embodiment, the neodymium, cerium and lanthanum contents are 1.7-2.1%, more preferably 1.7-1.9% by weight; 0.5-0.7%, more preferably 0.55-0.65% by weight; and 0.3-0.5% by weight respectively.

The zinc content is 0.3-0.8% by weight, preferably 0.4-0.7%, more preferably 0.5-0.6%.

The aluminium content is 0.02-0.1% by weight, preferably 0.03-0.09% by weight, more preferably 0.04-0.08% by weight, such as 0.05-0.07% by weight. Without wishing to be bound by theory, the inclusion of these small amounts of aluminium in the alloys of the present invention is believed to improve the creep properties of the alloys.

The beryllium content is 4-25 ppm, more preferably 4-20 ppm, more preferably 4-15 ppm, more preferably 6-13 ppm, such as 8-12 ppm. Beryllium would typically be introduced by way of an aluminium-beryllium master alloy, such as an Al-5% Be alloy. Without wishing to be bound by theory, the inclusion of beryllium is believed to improve the die castability of the alloy. Again, without wishing to be bound by theory, the inclusion of beryllium is also believed to improve the retention of the rare earth element(s) in the alloys against oxidation losses.

Reduction in iron content can be achieved by addition of zirconium which precipitates iron from the molten alloy. Accordingly, the zirconium contents specified herein are residual zirconium contents. However, it is to be noted that zirconium may be incorporated at two different stages. Firstly, on manufacture of the alloy and secondly, following melting of the alloy just prior to casting. Preferably, the zirconium content will be the minimum amount required to achieve satisfactory iron removal. Typically, the zirconium content will be less than 0.1%.

Manganese is an optional component of the alloy. When present, the manganese content will typically be about 0.1%.

Calcium (Ca) is an optional component which may be included, especially in circumstances where adequate melt protection through cover gas atmosphere control is not possible. This is particularly the case when the casting process does not involve a closed system.

Yttrium is an optional component which may be included. Without wishing to be bound by theory, the inclusion of yttrium is believed to beneficial to melt protection, ductility and creep resistance. When present, the yttrium content is preferably 0.1-0.4% by weight, more preferably 0.1-0.3% by weight.

Ideally, the incidental impurity content is zero but it is to be appreciated that this is essentially impossible. Accordingly, it is preferred that the incidental impurity content is less than 0.15%, more preferably less than 0.1%, more preferably less than 0.01%, and still more preferably less than 0.001%.

In a second aspect, the present invention provides a magnesium-based alloy consisting of 1.7-2.1% by weight neodymium, 0.5-0.7% by weight cerium, 0.3-0.5% by weight lanthanum, 0.03-0.09% by weight aluminium, 4-15 ppm beryllium; the remainder being magnesium except for incidental impurities and, optionally, trace amounts of rare earth elements other than neodymium, cerium and lanthanum.

In a third aspect, the present invention provides an engine block for an internal combustion engine produced by high pressure die casting an alloy according to the first or second aspects of the present invention.

In a fourth aspect, the present invention provides a component of an internal combustion engine formed from an alloy according to the first or second aspects of the present invention. The component of an internal combustion engine may be the engine block or a portion thereof such as a shroud.

Specific reference is made above to engine blocks but it is to be noted that alloys of the present invention may find use in other elevated temperature applications such as may be found in automotive powertrains as well as in low temperature applications. Specific reference is also made above to HPDC but it is to be noted that alloys of the present invention may be cast by techniques other than HPDC including thixomoulding, thixocasting, permanent moulding and sand casting.

EXAMPLES

Example 1

Three alloys were prepared and chemical analyses of the alloys are set out in Table 1 below. The rare earths other than neodymium were added as a Ce-based misch metal which contained cerium, lanthanum and some neodymium. The extra neodymium and the zinc were added in their elemental forms. The zirconium was added through a proprietary Mg—Zr master alloy known as AM-cast. Aluminium and beryllium were added through an aluminium-beryllium master alloy which contained 5% by weight of beryllium. Standard melt handling procedures were used throughout preparation of the alloys.

TABLE 1

| | Alloys Prepared | | |
|---|---|---|---|
| Element | Alloy A | Alloy B | Alloy C |
| Nd (wt %) | 1.61 | 1.86 | 1.85 |
| Ce (wt %) | 0.51 | 0.71 | 0.71 |
| La (wt %) | 0.49 | 0.48 | 0.49 |
| Zn (wt %) | 0.48 | 0.68 | 0.71 |
| Zr (wt %) | 0.1 | 0.06 | 0.06 |
| Ca (wt %) | — | <0.01 | 0.1 |
| Be (ppm) | — | 6 | 9 |
| Al (wt %) | — | 0.04 | 0.04 |

TABLE 1-continued

| | Alloys Prepared | | |
|---|---|---|---|
| Element | Alloy A | Alloy B | Alloy C |
| Mg (wt %) | Balance except for incidental impurities | Balance except for incidental impurities | Balance except for incidental impurities |

Alloys A, B and C were high pressure die cast and creep tests were carried out at a constant load of 90 MPa and at a temperature of 177° C. An additional creep test at 100 MPa and 177° C. was carried out for Alloy B. The steady state creep rates are listed in Table 2.

TABLE 2

| | Steady State Creep Rates | |
|---|---|---|
| | Steady State Creep Rates ($s^{-1}$) | |
| | 90 MPa 177° C. | 100 MPa 177° C. |
| Alloy A | $2 \times 10^{-9}$ | — |
| Alloy B | $1 \times 10^{-10}$ | $1 \times 10^{-10}$ |
| Alloy C | $1 \times 10^{-9}$ | — |

FIG. 1 shows the creep results for 177° C. and 90 MPa for Alloys A, B and C. The creep curve for Alloy B at 177° C. and 100 MPa is also shown. Both Alloy B and Alloy C are superior to Alloy A. The insert graph in FIG. 1 shows the initial primary behaviour of Alloy B at 177° C. and stresses of 90 MPa and 100 MPa. There is a higher initial response observed at 100 MPa but the creep curve levels out to show a very similar steady state creep rate to that at the lower stress.

The stress to give a value of 0.1% creep strain after 100 hours is often quoted when comparing various creep resistant magnesium alloys. Neither Alloy B nor Alloy C had creep strains of this order after 100 hours at 177° C. and 90 MPa, although creep strains in excess of that were reached at much longer test times. At 177° C. Alloy B and Alloy C would be acceptable for most automotive powertrain applications in terms of their creep behaviour.

The tensile properties were measured in accordance with ASTM E8 at 20, 100, 150 and 177° C. in air using an Instron Universal Testing Machine. Samples were held at temperature for 10 minutes prior to testing. The test specimens had a circular cross section (5.6 mm diameter), with a gauge length of 25 mm.

Tensile test results for Alloys A, B and C are set out in Table 3 and FIG. 2 illustrates typical Stress-Strain curves for the three alloys at room temperature and 177° C.

TABLE 3

| | Tensile Test Data | | | | | | | | |
|---|---|---|---|---|---|---|---|---|---|
| Alloy | Alloy A | | | Alloy B | | | Alloy C | | |
| Test Temperature, ° C. | 0.2% Proof MPa | UTS MPa | % E | 0.2% Proof MPa | UTS MPa | % E | 0.2% Proof MPa | UTS MPa | % E |
| 21 | 133 ± 5 | 151.4 ± 12.0 | 2.7 ± 1.0 | 139.8 ± 3.9 | 161.3 ± 4.2 | 1.9 ± 0.4 | 144.8 ± 4.0 | 165.1 ± 2.3 | 2.6 ± 0.4 |
| 100 | — | — | — | 140.7 ± 3.0 | 156.5 ± 5.9 | 3.4 ± 0.8 | 147.3 ± 4.2 | 155.0 ± 3.0 | 2.6 ± 0.9 |
| 150 | — | — | — | 134.5 ± 2.2 | 154.9 ± 9.4 | 4.6 ± 1.4 | 136.5 ± 3.5 | 150.0 ± 5.5 | 3.6 ± 0.5 |
| 177 | 118 ± 5 | 136 ± 5.3 | 5.5 ± 1.2 | 131.2 ± 4.3 | 149.0 ± 7.3 | 4.8 ± 1.0 | 134.1 ± 1.2 | 152.7 ± 3.3 | 4.4 ± 0.8 |

Alloys B and C and commercial alloy AZ91D were die cast in a triangular shaped die which had oil heating/cooling in both the fixed and moving halves of the mould. A thermocouple was present in the centre of the moving half.

The die was designed to provide both diverging and converging flow paths (see FIG. 3). This was achieved by having a fan gate that fed metal along the flat fixed half of the die (diverging), then flowed over the top section and then along the back wall (moving half of the die) back towards the gate (converging). This flow pattern gave an effective flow length of 130 mm, ie. twice the height of the casting.

Referring to FIG. 4, other features of the die are the large rib, that is formed along one side of the cast part, and the boss. The rib provides a very thick section parallel to the flow direction intended to reveal problems of channelling, where metal flows preferentially along a thick section. The boss is typical of many structural castings and is usually difficult to form. The corners where the boss and the rib meet the casting are sharp so as to maximise any hot or shrinkage cracking that may occur.

Finally the die had three strips of varying surface finish parallel to the flow direction. The surface finishes are full polish, semi-matt and full matt (EDM finish). These strips give an indication of the ease with which an alloy will form these surfaces. Accordingly, the die was designed to rigorously test the performance of any alloy cast in it by HPDC. A part cast from the die is illustrated in FIG. 4.

Particulars of the HPDC conditions for the die are set out below.

| | |
|---|---|
| Gate Dimensions = | 58 mm × 1 mm |
| Plunger Diameter. = | 50 mm |
| High Speed = | 2.25 m/s |
| Slow Speed = | 0.35 m/s |
| Gate Velocity = | $V_{plunger} \times A_{plunger}/A_{gate}$ |
| = | 76 m/s |

AZ91D was cast with a molten metal temperature of 700° C. and an estimated die temperature of 200° C.; whereas, Alloys B and C were cast with a molten metal temperature of 740° C. and an estimated die temperature of 250° C.

Castings made with both AZ91D and Alloys B and C had a high quality surface finish although the AZ91D castings did have some surface cold shuts which may indicate that the oil temperature, and hence die temperature, should have been slightly higher. The molten metal temperature for AZ91D was in the upper region for normal HPDC casting of AZ91D. The surface finishes on both sides of the castings from Alloys B and C were good which demonstrated that both alloys can flow reasonable distances.

All alloys cast with equivalent castability although Alloys B and C did have a more rapid reduction in quality at the limit of their operating windows. For example, if insufficient metal was dosed into the shot sleeve, which led to a reduction in the molten metal temperature entering the cavity, then surface quality diminished rapidly.

For all alloys, the holding time in the die was varied so that some idea of the cracking propensity could be determined. The casting has many thick and thin sections with sharp corners at the changes in section thickness, which should have meant that the resultant castings should exhibit cracks. In the castings of Alloys B and C there were no signs of cracking while in the AZ91D castings there were some signs of hot tearing in one section of the large rib.

The die casting trial demonstrated that Alloys B and C have excellent die castability approximately equivalent to AZ91D although the melt temperature and die temperature required for Alloys B and C were higher than that required for AZ91D.

Example 2

A series of alloys were produced and their compositions are listed in Table 4 below. In each of Alloys D-Y, except for any incidental impurities, the balance of the alloy was magnesium.

TABLE 4

Chemical compositions of Alloys D-Y

| Alloy | Nd (wt. %) | Ce (wt. %) | La (wt. %) | Zn (wt. %) | Be (ppm) | Al (wt. %) | Fe (ppm) | Zr (soluble) (wt. %) | Zr (total) (wt. %) |
|---|---|---|---|---|---|---|---|---|---|
| D | 1.55 | 0.50 | 0.48 | 0.50 | Not Added | <0.01 | 20 | — | 0.10 |
| E | 1.85 | 0.71 | 0.48 | 0.68 | 6 | 0.04 | — | — | 0.07 |
| F | 1.84 | 0.69 | 0.49 | 0.62 | <1 | <0.01 | — | 0.09 | 0.16 |
| G | 1.70 | 0.66 | 0.49 | 0.60 | <1 | 0.03 | — | 0.015 | 0.05 |
| H | 1.38 | 0.60 | 0.47 | 0.61 | <1 | 0.07 | — | 0.01 | 0.03 |
| I | 1.13 | 0.46 | 0.33 | 0.47 | <1 | 0.03 | — | <0.01 | 0.015 |
| J | 1.15 | 0.46 | 0.34 | 0.49 | 7 | 0.11 | — | 0.01 | 0.03 |
| K | 0.82 | 0.29 | 1.51 | 0.59 | 8 | 0.09 | — | <0.005 | 0.011 |
| L | 0.81 | 0.29 | 1.80 | 0.60 | 9 | 0.08 | — | <0.005 | 0.020 |
| M | 1.55 | 0.58 | 0.34 | 0.59 | 7 | 0.09 | <5 | 0.015 | 0.026 |
| N | 1.41 | 0.55 | 0.33 | 0.60 | 5 | 0.05 | 6 | 0.014 | 0.030 |
| O | 1.43 | 0.56 | 0.33 | 0.59 | 13 | 0.09 | 5 | 0.012 | 0.028 |
| P | 1.45 | 0.56 | 0.32 | 0.60 | 11 | 0.12 | 5 | 0.010 | 0.028 |
| Q | 1.46 | 0.55 | 0.32 | 0.57 | 13 | 0.23 | <5 | <0.005 | 0.012 |
| R | 1.71 | 0.56 | 0.31 | 0.59 | 11 | 0.05 | 67 | 0.003 | 0.012 |
| S | 2.00 | 0.54 | 0.31 | 0.60 | 8 | 0.05 | 69 | 0.003 | 0.009 |
| T | 1.90 | 0.55 | 0.42 | 0.60 | 5 | 0.05 | 58 | <0.005 | 0.008 |
| U | 1.71 | 0.66 | 0.51 | 0.58 | 4 | 0.05 | 58 | <0.005 | 0.005 |
| V | 1.66 | 0.65 | 0.50 | 0.61 | 6 | 0.06 | 62 | <0.005 | 0.006 |
| W | 1.61 | 0.64 | 0.49 | 0.59 | 5 | 0.07 | 59 | <0.005 | 0.005 |
| X | 1.78 | 0.65 | 0.49 | 0.61 | 5 | 0.11 | 57 | <0.005 | 0.005 |
| Y | 1.74 | 0.56 | 0.41 | 0.58 | 13 | 0.07 | 5 | 0.008 | 0.036 |

For the purposes of mechanical property evaluation, test specimens were produced by the high pressure die casting (HPDC) of the alloys on a 250 tonne Toshiba cold chamber machine. Two dies were designed with magnesium alloys in mind to cast tensile/creep specimens and bolt load retention bosses. The alloy properties that were evaluated included casting quality, as-cast microstructure, tensile strength at room temperature and 177° C., creep behaviour at 150° C. and 177° C., and bolt load retention (BLR) behaviour at 150° C. and 177° C.

A typical example of the microstructure of an alloy according to the present invention (Alloy G) in the as-cast condition, is shown in FIG. 5. Due to the nature of HPDC there is a transition from a fine grain structure, close to the surface of the cast specimen (the "skin"), to a coarser grain structure in the central region (the "core"). Both regions consist of primary magnesium-rich grains or dendrites with a Mg—RE intermetallic phase in the inter-granular and interdendritic regions.

A summary of the tensile test data for various of the alloys is given in Table 5 below and it can be seen that the tensile behaviour of alloys according to the present invention is very good at both of the test temperatures considered.

TABLE 5

Tensile properties of various alloys at room temperature and 177° C.

| | 20° C. | | | 177° C. | | |
|---|---|---|---|---|---|---|
| Alloy | 0.2% Proof, (MPa) | UTS, (MPa) | % Elong. | 0.2% Proof, (MPa) | UTS, (MPa) | % Elong. |
| D | 133 ± 5.0 | 151.4 ± 12.0 | 2.7 ± 1.0 | 118 ± 5.0 | 136 ± 5.3 | 5.5 ± 1.1 |
| E | 139.8 ± 3.9 | 161.3 ± 4.2 | 1.9 ± 0.4 | 131.2 ± 4.3 | 149.6 ± 7.3 | 4.8 ± 1.0 |
| F | 148.4 ± 4.1 | 159.1 ± 8.8 | 2.0 ± 1.0 | 127.1 ± 1.7 | 135.5 ± 7.4 | 3.5 ± 1.3 |
| G | 143.8 ± 2.5 | 166.3 ± 3.5 | 3.0 ± 0.5 | 128.1 ± 2.6 | 145.9 ± 11.3 | 4.7 ± 1.3 |
| H | 130.8 ± 4.2 | 149.4 ± 12.8 | 2.0 ± 1.0 | 115.2 ± 3.1 | 125.0 ± 6.1 | 3.9 ± 0.9 |
| I | 122.5 ± 2.1 | 157.4 ± 7.0 | 4.5 ± 0.6 | 109.1 ± 1.7 | 134.3 ± 4.7 | 7.1 ± 1.8 |
| J | 112.7 ± 7.4 | 141.0 ± 2.1 | 3.0 ± 0.4 | 105.8 ± 1.1 | 125.5 ± 5.4 | 5.7 ± 1.0 |
| M | 129.4 ± 6.8 | 147.4 ± 6.7 | 2.3 ± 0.9 | 109.3 ± 7.7 | 129.4 ± 3.2 | 4.1 ± 0.7 |
| N | 130.5 ± 1.1 | 157.3 ± 9.0 | 3.6 ± 0.8 | 111.2 ± 6.6 | 141.2 ± 7.8 | 6.0 ± 1.2 |
| O | 123.9 ± 3.5 | 150.9 ± 5.2 | 3.0 ± 0.6 | 107.8 ± 8.7 | 137.9 ± 5.5 | 5.8 ± 1.1 |
| P | 125.2 ± 2.8 | 146.7 ± 5.9 | 2.8 ± 0.3 | 113.1 ± 2.1 | 132.6 ± 8.4 | 4.5 ± 0.8 |
| Q | 124.6 ± 2.4 | 147.1 ± 3.7 | 2.7 ± 0.6 | 108.2 ± 6.8 | 129.6 ± 1.9 | 4.3 ± 0.7 |
| R | 127.5 ± 5.0 | 167.9 ± 6.4 | 4.3 ± 0.6 | 117.7 ± 4.1 | 147.2 ± 2.1 | 7.0 ± 0.6 |
| S | 131.2 ± 4.0 | 159.2 ± 6.8 | 3.3 ± 0.7 | 121.6 ± 1.2 | 146.2 ± 4.7 | 5.8 ± 0.6 |
| T | 138.7 ± 2.6 | 166.5 ± 3.5 | 3.9 ± 0.3 | 124.4 ± 1.8 | 150.4 ± 4.0 | 6.0 ± 0.8 |
| U | 136.8 ± 2.9 | 165.4 ± 6.3 | 3.7 ± 0.3 | 124.5 ± 1.6 | 146.7 ± 3.8 | 5.3 ± 0.8 |
| V | 135.2 ± 1.2 | 154.3 ± 6.4 | 2.6 ± 0.8 | 122.2 ± 2.5 | 144.9 ± 5.4 | 5.2 ± 0.7 |
| W | 130.0 ± 1.7 | 154.0 ± 5.7 | 2.7 ± 0.5 | 115.9 ± 2.9 | 138.8 ± 6.0 | 4.3 ± 0.9 |
| X | 134.2 ± 6.2 | 156.0 ± 4.3 | 2.6 ± 0.8 | 116.6 ± 4.5 | 138.0 ± 3.6 | 4.1 ± 0.5 |

A summary of the secondary creep rates under the same conditions of 177° C. and 90 MPa for various of the alloys are contained in Table 6 below. These test conditions were chosen specifically to provide a stringent test that would identify magnesium alloys with creep properties suitable for demanding automotive powertrain applications.

TABLE 6

Steady-state creep rates of various alloys.

| Alloy | Steady State Creep Rate at 177° C. and 90 MPa, ($s^{-1}$) |
|---|---|
| D | $1.9 \times 10^{-9}$ |
| E | $1.0 \times 10^{-10}$ |
| F | $1.4 \times 10^{-9}$ |
| G | $3.0 \times 10^{-11}$ |

TABLE 6-continued

Steady-state creep rates of various alloys.

| Alloy | Steady State Creep Rate at 177° C. and 90 MPa, ($s^{-1}$) |
|---|---|
| H | $2.5 \times 10^{-10}$ |
| I | $1.8 \times 10^{-10}$ |
| J | $1.2 \times 10^{-9}$ |
| N | $3.0 \times 10^{-11}$ |
| O | $6.0 \times 10^{-11}$ |
| P | $1.0 \times 10^{-9}$ |
| Q | $6.1 \times 10^{-8}$ |
| R | $6.4 \times 10^{-10}$ |
| S | $5.5 \times 10^{-10}$ |
| T | $3.3 \times 10^{-10}$ |
| U | $2.2 \times 10^{-10}$ |
| V | $3.1 \times 10^{-10}$ |
| W | $6.9 \times 10^{-11}$ |

These results can be divided into three groups depending on the observed creep behaviour and the Al content of the alloy. The first group contains those alloys which have an Al content of less than 0.03 wt. % (Alloys D and F) and it can be seen that these compositions display a relatively high secondary creep rate. The second group contains those alloys which have an Al content of more than 0.02 wt. % and less than 0.11 wt. % (Alloys E, G, H, I, N, O, R, S, T, U, V and W) and it can be seen that these alloys display secondary creep rates that are very low, in the range of $10^{-10}$-$10^{-11}$ $s^{-1}$, and therefore these compositions would be classified as very creep resistant under these test conditions. This is illustrated by the comparison of the creep behaviour, at 177° C. and 90 MPa, of Alloys E and F in FIG. 6. The two alloys have very similar base compositions; however, Alloy F with a low Al content (Al <0.01 wt. %) has a vastly inferior creep performance when compared to that of Alloy E (Al 0.04 wt. %). The third group contains those alloys which have an Al content of 0.11 wt. % or greater (Alloys J, P and Q) and it can be seen that these compositions also display relatively high secondary creep rates, as observed for group one and therefore both groups one and three would be classified as not being sufficiently creep resistant under the imposed test conditions. Therefore, these results suggest that under these extreme test conditions (177° C. and 90 MPa) there is an optimum Al content within which an alloy composition must remain to achieve a creep performance that is suitable for the most demanding powertrain applications. This is most dramatically illustrated by the comparison of the creep behaviour of Alloys N, O, P and Q tested at 177° C. and 90 MPa as shown in FIG. 8. All of these alloys possess very similar compositions apart from the Al content. The transition in creep behaviour across these four compositions from extremely good for Alloy N to extremely poor for Alloy Q with an increase in Al content from 0.05 wt. % to 0.23 wt. % is clear.

The BLR behaviour for Alloy Y was measured at 150° C. and 177° C., with loads of 8 kN and 11 kN. The results are presented in two charts:

The overall percentage load retained after returning to room temperature (FIG. 8), and The percentage load retained at the test temperature, being the creep component of the overall behaviour (FIG. 9).

The invention claimed is:

1. A magnesium-based alloy consisting of 1.7-2.1% by weight neodymium, 0.5-0.7% by weight cerium, 0.3-0.5% by weight lanthanum, 0.03-0.09% by weight aluminium, 0.3-0.8% by weight zinc, 4-15 ppm beryllium; the remainder being magnesium except for incidental impurities and, optionally, trace amounts of rare earth elements other than neodymium, cerium and lanthanum.

2. A component of an internal combustion engine or automotive powertrain formed from an alloy as claimed in claim 1.

3. An engine block or portion thereof produced by high pressure die casting an alloy as claimed in claim 1.

4. An alloy as claimed in claim 1 having the rare earth elements content including neodymium of 2.5-3.3% by weight.

5. An alloy as claimed in claim 1 wherein the content of rare earth elements other than neodymium is 0.8-1.2% by weight of the alloy.

6. An alloy as claimed in claim 1 having a zinc content of 0.4-0.7% by weight.

7. An alloy as claimed in claim 1 having an aluminium content of 0.04-0.08% by weight.

8. An alloy as claimed in claim 1 having an aluminium content of 0.05-0.07% by weight.

9. An alloy as claimed in claim 1 having a beryllium content of 8-12 ppm.

* * * * *